US006979804B1

(12) United States Patent
Boyer

(10) Patent No.: US 6,979,804 B1
(45) Date of Patent: Dec. 27, 2005

(54) AUTOMATED OVEN CALIBRATION SYSTEM

(75) Inventor: Mark A. Boyer, Harrison, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/854,670

(22) Filed: May 27, 2004

(51) Int. Cl.[7] ..... H05B 1/02

(52) U.S. Cl. ..... 219/494; 219/492; 219/412; 374/1

(58) Field of Search ..... 219/494, 497, 219/508, 492, 501, 505, 412–414; 374/1

(56) References Cited

U.S. PATENT DOCUMENTS 4,313,977 A * 2/1982 Johnson et al. ..... 427/342
4,580,025 A * 4/1986 Carlson et al. ..... 219/708
5,253,564 A * 10/1993 Rosenbrock et al. ..... 99/328
5,488,368 A * 1/1996 Brown et al. ..... 341/119
5,844,207 A 12/1998 Allard et al.
5,958,246 A * 9/1999 Tipler et al. ..... 210/656
5,967,661 A * 10/1999 Renken et al. ..... 374/126
5,990,460 A 11/1999 Petty et al.
6,157,198 A * 12/2000 Mauerman ..... 324/601
6,232,582 B1 5/2001 Minnear et al.
6,271,506 B1 8/2001 Glaser
6,431,747 B1 * 8/2002 Danley ..... 374/10

* cited by examiner

*Primary Examiner*—Mark Paschall
(74) *Attorney, Agent, or Firm*—Diederiks & Whitelaw, PLC

(57) ABSTRACT

A cooking appliance includes an oven cavity, an electric heating element, a control element for selecting an oven cavity temperature, a timer and a calibration system for regulating operational parameters of the cooking appliance. The calibration system adjusts operational parameters of the cooking appliance based upon an amount of time required to achieve the selected oven cavity temperature. Preferably, the timer measures the amount of time needed to achieve the oven cavity temperature during a no load condition in order to set a baseline. Once the time is determined, the calibration system adjusts offset temperatures, hysterisis temperatures and/or cooking times to account for variations in power delivered to the oven cavity.

18 Claims, 1 Drawing Sheet

AUTOMATED OVEN CALIBRATION SYSTEM

BACKGROUND OF THE INVENTION

1. Field of the Invention

The present invention pertains to the art of cooking appliances and, more particularly, to a cooking appliance having an automated calibration system that maintains operational parameters of the cooking appliance within optimal limits.

2. Discussion of the Prior Art

In general, it is known that electric cooking appliances are affected by variations in supply voltage. That is, as electric cooking appliances utilize electric heating elements that output power, variations in supply voltage will result in variations in power output. Given that $P=V^2/R$, a ten-volt variation in voltage will result in a significantly greater variation in power output by the electric heating element. In cooking appliances, variations in supply voltage can alter the time it takes to achieve a desired cooking temperature. In addition, variations in supply voltages make maintaining a desired temperature more difficult. When the cooking appliance is not operating under optimal conditions, pre-established operating parameters will not be able to achieve or maintain desired output conditions. Food could end up being either over or under-cooked. For example, when operating an electric cooking appliance that is programmed with a cook time, the established cook time may not be sufficient to properly cook the food if significant voltage variations occur during the cooking operation. Based thereon, it is considered important to periodically calibrate or adjust the operational parameters to correspond to the amount of heat produced by the electric elements.

In recognition of this problem, the prior art contains several examples of systems designed to compensate for variations in supply voltage. Some of these systems monitor the supply voltage and, based on the monitored voltage, alter an overall cook time for a cooking operation. Other systems monitor the supply voltage, then compare the supply voltage with a known, nominal value. The difference, if any, between the supply voltage and the known value is used to set particular cycle times of one or more electric heating elements. In still other systems, a controller monitors power and voltage values. These values are compared to stored data to determine particular cycle times of a heating element. While each of the above systems is generally effective, they fail to account for other factors which can influence power output by an electric heating element.

In addition to supply voltage variations, the resistance of an electric heating element will change over time. A change in resistance of the element will also have an effect on the amount of power output by the element. Also, the degradation of insulation around the cooking appliance and door sealing characteristics will affect the amount of heat needed to maintain a particular temperature within an appliance. None of the examples proposed in the prior art address these issues. In addition, the prior art systems are not considered to be readily adaptable to new oven designs.

Based on the above, there still exists a need in the art for an oven calibration system that will effectively maintain an oven temperature regardless of variations in supply voltage. More specifically, there exists a need for an oven calibration system that will also account for changes in oven performance resulting from ordinary wear of the cooking appliance in order to remain within optimal operating conditions.

SUMMARY OF THE INVENTION

The present invention is directed to a cooking appliance including an oven cavity, an electric heating element, a control element for selecting a desired oven cavity temperature ($T_P$), a timer, a control unit, and an automated calibration system, wherein the calibration system regulates or adjusts established operational parameters of the cooking appliance based upon a time/temperature relationship in order to ensure optimal cooking operations. Preferably, the timer determines an amount of time required to achieve the oven cavity temperature ($T_P$) during a no load condition. That is, the timer measures the amount of time it takes to reach a selected temperature ($T_P$) when there is no food or other items in the oven cavity that might otherwise absorb a portion of the heat. In accordance with a preferred embodiment of the invention, the calibration system is operated during a self-clean mode of operation as no food will be present in the oven cavity. During the self-clean mode, the electric heating element is operated at maximum capacity until a desired temperature ($T_{SC}$) is achieved. In this manner, an accurate measurement, corresponding to power output by the heating element, can be obtained. Once obtained, the calibration system can adjust the established operational parameters, such as offset temperatures, hysterisis temperatures and cooking times, in order to account for variations in heat delivered to and retained by the oven cavity.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
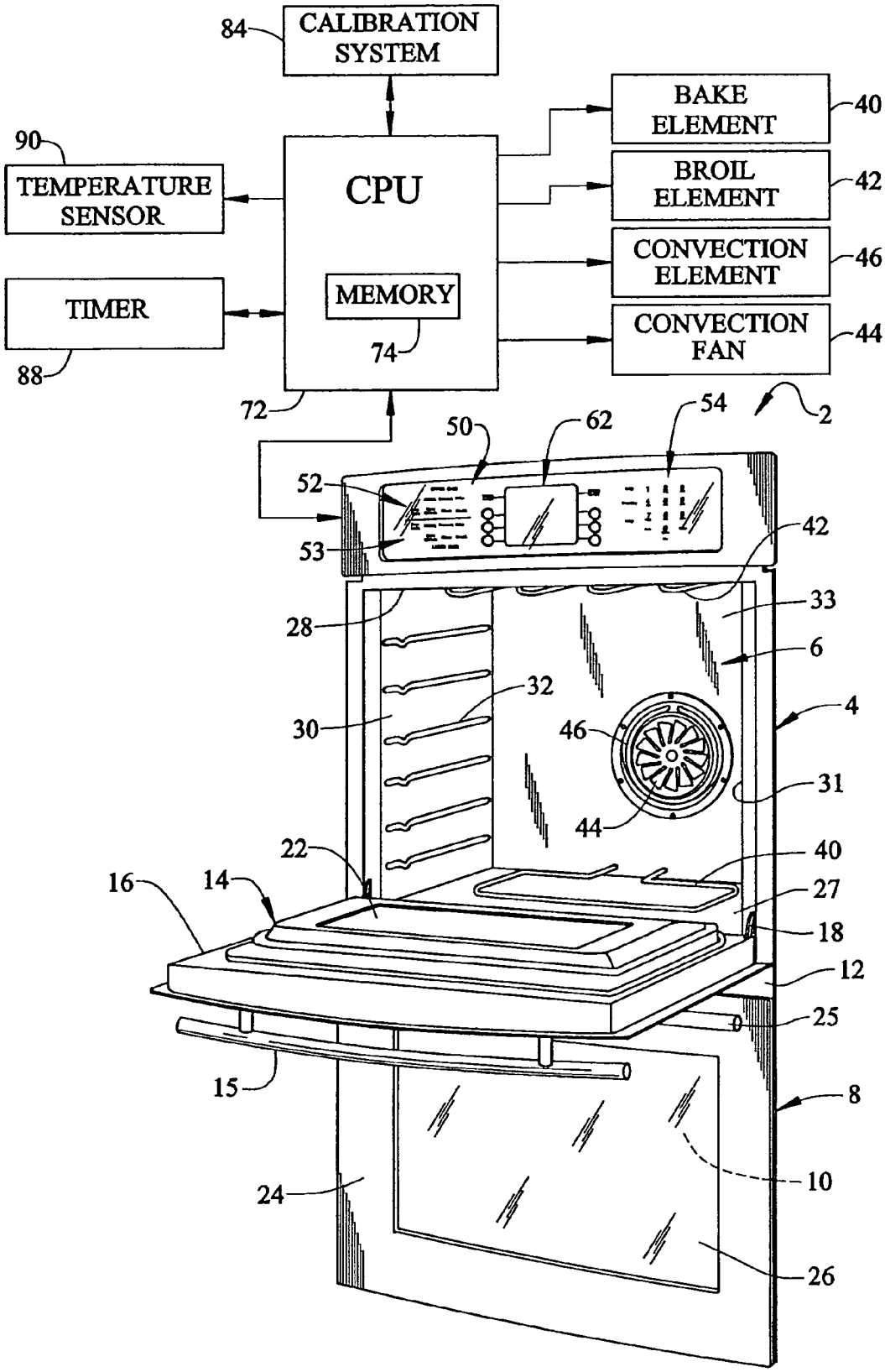
FIG. 1 is a perspective view of a wall oven including an automated calibration system constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention is not limited to this model type and can be incorporated into various types of oven configurations, e.g., cabinet mounted ovens, as well as both slide-in and free-standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for, at least, partially supporting both upper and lower oven cavities 6 and 10.

In a manner known in the art, a door assembly 14 is pivotally mounted to outer frame 12 and, when in a closed position, extends across oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. A corresponding door assembly 24, including a handle 25 and a transparent zone or window 26, is provided to selectively access lower oven cavity 10.

As best seen in FIG. 1, oven cavity 6 is defined by a bottom wall 27, an upper wall 28, opposing side walls 30 and 31 and a rear wall 33. In a manner known in the art, side walls 30 and 31 are provided with a plurality of vertically spaced side rails indicated generally at 34 for supported oven racks and the like in oven cavity 6. In the preferred embodiment shown, bottom wall 27 is constituted by a flat, smooth surface designed to enhance the cleanability of oven cavity 6. Arranged about bottom wall 27 of oven cavity 6 is a bake element 40. Also, a top broiler element 42 is arranged along upper wall 28 of oven cavity 6. Top broiler element 42 is provided to enable a consumer to perform a grilling process in upper oven 4 and to aid in pyrolytic heating during a self-clean operation. More specifically, both bake element 40 and top broiler element 42 are constituted by sheathed electric resistive heating elements.

Based on the above, in the preferred embodiment depicted, cooking appliance 2 actually constitutes an electric, dual wall oven. However, it is to be understood that cooking appliance 2 could also incorporate various other heat sources, such as a microwave generator, to supplement the operation of bake element 40 and top broiler element 42. In any case, both oven cavities 6 and 10 preferably employ both radiant and convection heating techniques for cooking food items therein. To this end, rear wall 33 is shown to include a convection fan or blower 44. Although the exact position and construction of fan 44 can readily vary in accordance with the invention, fan 44 draws in air at a central intake zone (not separately labeled) and directs the air into oven cavity 6 in a radial outward direction. Also, as clearly shown in this figure, a convection heating element 46, which preferably takes the general form of a ring, extends circumferentially about fan 44 in order to heat the radially expelled air flow. At this point, it should be noted that a fan cover, which has not been shown for the sake of clarity of the drawings, extends about fan 44 and convection heating element 46, preferably with the cover having an associated central inlet and a plurality of outer radial outlet openings.

As further shown in FIG. 1, cooking appliance 2 includes an upper control panel 50 having a plurality of control elements. In accordance with one embodiment, the control elements are constituted by first and second sets of oven control buttons 52 and 53, as well as a numeric pad 54. Control panel 50 is adapted to be used to select desired cooking operations and, as will be discussed more fully below, input initial operating conditions for cooking appliance 2. More specifically, the first and second sets of control buttons 52 and 53, in combination with numeric pad 54 and a display 62, enable a user to establish particular cooking operations, e.g., a bake mode, a broil mode, a convection cooking mode and a self-clean mode for upper and lower ovens 4 and 8 respectively and, if so equipped, selection from a menu of pre-programmed cooking operations. This arrangement has been described in co-pending application Ser. No. 10/410,155 filed Apr. 10, 2003, which is entitled "Menu Driven Control System for a Cooking Appliance," assigned to the assignee of the present application and incorporated herein by reference.

In accordance with a preferred form of the present invention, a control unit or CPU 72, having a non-volatile memory unit 74, is provided to control cooking appliance 2. As will be discussed more fully below, CPU 72 operates or controls cooking appliance 2 based on established operating parameters stored in memory 74. That is, in order to achieve and maintain a desired temperature, various factory set operating parameters, such as offset temperatures, hysterisis temperatures and cook times, are stored in memory 74. Upon selection of a desired cooking temperature ($T_P$) or a pre-programmed cooking operation, cooking appliance 2 will enter a pre-heat mode during which CPU 72 will activate one or more of the electric heating element(s), i.e., bake element 40, broil element 42 and/or convection element 46, to begin raising the temperature in oven cavity 6 to the desired temperature ($T_P$). Once the desired temperature ($T_P$) is reached, cooking appliance 2 will enter a cooking mode during which time CPU 72 will begin to cycle the operation of the heating element(s) 40, 42, 46 to maintain the temperature ($T_P$).

Actually, in order to maintain the desired temperature ($T_P$) in oven cavity 6, CPU 72 activates the electric heating element(s) 40, 42, 46 until reaching the desired temperature ($T_P$) plus an upper offset temperature value ($T_1$). Once the upper offset temperature value is reached, the heating element(s) 40, 42, 46 is deactivated. The temperature in oven cavity 6 is then allowed to fall, past the desired temperature ($T_P$), until reaching a second or lower offset temperature value ($T_2$), at which time the electric heating element(s) 40, 42, 46 is reactivated. In accordance with the invention, the upper and lower offset temperature values ($T_1$ and $T_2$) may be identical or may differ depending on various operating conditions, such as supply voltage, heating element power rating, oven cavity size, and other various dynamics of cooking appliance 2. In any event, the difference between the upper offset temperature ($T_1$) and the lower offset temperature ($T_2$) define a hysterisis temperature ($T_H$). CPU 72 continues to periodically cycle operation of the electric heating element(s) 40, 42, 46 to maintain the desired temperature ($T_P$), which is actually an average temperature value defined by a hysterisis temperature loop, until the cooking operation is terminated, either through user input or automatically by CPU 72.

The established operating parameters are actually values based upon ideal operating conditions. That is, the offset temperatures ($T_1$ and $T_2$), hysterisis temperature ($T_H$) and cook times are based upon operating the heating element(s) 40, 42, 46 at a defined supply voltage in order to achieve a rated power output. Unfortunately, it is not always possible to operate under ideal conditions. Supply voltages vary, heating elements degrade over time and a variety of other factors all contribute to cooking appliance 2 operating at less than ideal conditions. Therefore, in order to operate more efficiently, it becomes necessary to periodically calibrate cooking appliance 2. Toward that end, cooking appliance 2 includes an automated calibration system 84 which functions to periodically adjust established operational parameters of cooking appliance 2.

In accordance with one preferred form of the invention, after a user selects a particular cooking operation and a desired temperature value ($T_P$) for the particular cooking operation, CPU 72 activates at least one of electric heating elements 40, 42 and 46 to elevate a temperature of oven cavity 6 to correspond to the desired temperature value ($T_P$). At the same time, CPU 72 initiates a timer 88 that measures a time period by incrementing a counter indicative of a time value. CPU 72 also begins to receive signals from a temperature sensor 90 that is positioned to sense the temperature in oven cavity 6. Once CPU 72 receives a signal from sensor 90 that oven cavity 6 has reached the desired temperature ($T_P$), timer 88 is stopped, while the heating element(s) 40, 42 and 46 continues to operate until oven cavity 6 reaches the upper offset temperature. At this point, CPU 72 passes a signal representative of the desired temperature ($T_P$) and the time value in timer 88 to calibration system 84. As an alternative to measuring an elapsed period of time, timer 88 could also countdown from a predetermined value. In this case, any difference between the elapsed time and the predetermined value at the moment $T_P$ is reached is sent to calibration system 84.

The desired temperature value ($T_P$) and the time value are input into a control algorithm in calibration system 84. The control algorithm then calculates a power value corresponding to the power necessary to achieve the desired temperature ($T_P$) in the time period measured by timer 84. Once the power value is determined, calibration system 84 will, if necessary, make adjustments to the established operational parameters of cooking appliance 2. That is, if the calculated power value indicates that cooking appliance 2 is not operating within an optimal range, calibration system 84 will adjust the established operating parameters, e.g., adjust the upper and lower offset temperatures ($T_1$ and $T_2$), the hysterisis temperature (TH) or the cook time, in order to bring the operation of cooking appliance 2 within the optimal range. More specifically, if it is found to take longer to reach $T_1$, the value of $T_2$ is increased to prevent the oven from losing too much heat. Likewise, if the time to reach $T_1$ decreases, $T_2$ can be decreased. The adjusted or calibrated operational parameters then replace the established values in memory 74 for use in subsequent cooking operations. In this manner, food placed within oven cavity 6 will be cooked properly, that is, over and under-cooked conditions can be avoided. Moreover, if the user selects a pre-established cooking operation that uses a predetermined cook time, calibration system 84 will ensure that the cooking operation will be completed properly and on time.

The ideal time to initiate calibration system 84 is during periods when oven cavity 6 is empty, i.e., when there is no load present that would otherwise absorb heat output by the heating element(s). Therefore, in accordance with the most preferred form of the present invention, calibration system 84 is automatically activated during the self-clean mode of operation. In one preferred form of the invention, once a user selects the self-clean mode, CPU 72 actives heating elements 40, 42 and 46 to elevate the temperature of oven cavity 6 to correspond to a self-clean temperature value ($T_{SC}$). In a manner similar to that described above, once heating elements 40, 42, and 46 are activated, timer 88 is initiated. CPU 72 continues to poll sensor 90 at least until a signal, representative of the self-clean temperature value ($T_{SC}$), is returned. Once oven cavity 6 has reached the self-clean temperature ($T_{SC}$), as evidenced by the return signal from sensor 90, timer 88 is stopped. At this point, the time value is passed to calibration system 84. Implementing the control algorithm, calibration system 84 determines if adjustments to the established operational parameters of cooking appliance 2 are required to compensate for variations in performance. If so, the adjusted or calibrated operational parameters are then stored in memory 74 so that future cooking operations are performed in the most efficient manner.

With this arrangement, the established operating parameters can be periodically updated to account for variations in supply voltage, changes over time in the resistance of the heating element(s), and other factors that would otherwise contribute to inefficient cooking operations. Furthermore, the calibration system of the present invention is forward looking in that a control system is provided that is adaptable to a wide array of oven cavity geometries, as well as future cooking appliance designs. Although described with reference to a preferred embodiment of the present invention, it should be readily apparent to one of ordinary skill in the art that various changes and/or modifications can be made to the invention without departing from the spirit thereof. For instance, the invention could also be employed with other types of electric cooking appliances, such as ranges, slide-in units and the like. In addition, the calibration system could determine the power value by using a sensed temperature at a prescribed time period. Furthermore, while the timer is described as being stopped once the desired temperature is reached, the timer could continue to operate until the upper offset temperature is reached. In general, the invention is only intended to be limited by the scope of the following claims.

What is claimed is:

1. A cooking appliance comprising:

an oven cavity including top, bottom, rear and opposing side walls;

an electric heating element positioned to selectively heat the oven cavity;

means for selecting a desired heating operation;

means for controlling the electric heating element based on established operating parameters;

means for measuring an amount of time;

means for sensing a temperature of the oven cavity; and means for automatically calibrating the cooking appliance by adjusting the established operational parameters based upon the amount of time required to reach the temperature sensed by the temperature sensing means.

2. The cooking appliance according to claim 1, wherein the heating operation includes at least one of a bake mode, a broil mode and a self-clean mode, said automatic calibrations means operating during the self-clean mode.

3. The cooking appliance according to claim 2, wherein the automatic calibration means only operates during the self-clean mode.

4. The cooking appliance according to claim 3, wherein the automatic calibrating means adjusts the established operational parameters of the cooking appliance based upon the amount of time required to achieve a self-clean temperature.

5. The cooking appliance according to claim 1, further comprising a non-volatile memory for storing the established operating parameters.

6. The cooking appliance according to claim 1, wherein the operational parameters include at least one of an offset temperature, a hysterisis temperature and a cooking time.

7. The cooking appliance according to claim 1, wherein the electric heating element constitutes a convection cooking system which performs at least a portion of the cooking operation.

8. The cooking appliance according to claim 1, wherein the cooking appliance is a wall oven.

9. The cooking appliance according to claim 1, wherein the electric heating element is an sheathed electric resistance-type heating element.

10. The cooking appliance according to claim 1, wherein the measuring means includes a count-down timer.

11. A method of calibrating a cooking appliance comprising:

selecting a desired oven cavity temperature for a heating operation;

operating an electric heating element to establish the desired oven cavity temperature based on established operating parameters of the cooking appliance;

sensing a temperature in the oven cavity;

measuring an amount of time needed to achieve the desired oven cavity temperature; and adjusting the established operational parameters of the cooking appliance based upon the measured time.

12. The method according to claim 11, further comprising: performing at least one of a bake mode, a broil mode and a self-clean mode as the heating operation.

13. The method of claim 11, wherein the established operational parameters are adjusted when the cooking appliance is operating in the self-clean mode.

14. The method according to claim 11, wherein the operational parameters of the cooking appliance are adjusted based upon an amount of time required to achieve a self-clean temperature during the self-clean mode.

15. The method of claim 11, wherein adjusting the established operational parameters establishes calibrated operational parameters for the cooking appliance.

16. The method of claim 15, further comprising: storing the calibrated operational parameters as the established operational parameters for a subsequent heating operation in a memory.

17. The method according to claim 11, wherein adjusting the operational parameters includes setting at least one of an offset temperature, establishing a hysterisis temperature and altering a cooking time.

18. The method according to claim 11, wherein measuring an amount of time includes decrementing a timer.

* * * * *